US009500425B1

(12) United States Patent
Lawrence

(10) Patent No.: US 9,500,425 B1
(45) Date of Patent: Nov. 22, 2016

(54) WEAPON DIRECTION TRAINING SYSTEM AND RELATED METHODS

(76) Inventor: Jonathan G. Lawrence, Tucson, AZ (US)

( * ) Notice: Subject to any disclaimer, the term of this patent is extended or adjusted under 35 U.S.C. 154(b) by 1089 days.

(21) Appl. No.: 13/571,137

(22) Filed: Aug. 9, 2012

(51) Int. Cl.
*F41A 17/08* (2006.01)
*F41A 17/00* (2006.01)

(52) U.S. Cl.
CPC ..... *F41A 17/08* (2013.01); *F41A 17/00* (2013.01)

(58) Field of Classification Search
CPC ..... F41A 33/00; F41A 33/02; F41A 17/08; F41A 17/063; F41A 17/46; F41A 17/06; F41A 17/066; F41A 21/00; F41A 99/00; F41A 17/0008
USPC ..... 434/11–26
See application file for complete search history.

(56) References Cited

U.S. PATENT DOCUMENTS

| | | | | |
|---|---|---|---|---|
| 3,400,393 | A | 9/1968 | Ash | |
| 4,833,452 | A * | 5/1989 | Currier | G08B 3/1083 340/539.11 |
| 5,183,951 | A | 2/1993 | Bilodeau | |
| 5,307,053 | A | 4/1994 | Wills et al. | |
| 5,564,211 | A | 10/1996 | Mossberg et al. | |
| 7,308,202 | B2 | 12/2007 | Roes et al. | |
| 8,179,247 | B2 | 5/2012 | Ivtsenkov et al. | |
| 2007/0009859 | A1 * | 1/2007 | Preston | F41A 33/00 434/11 |
| 2007/0205890 | A1 | 9/2007 | Brown | |
| 2007/0236384 | A1 | 10/2007 | Ivtsenkov et al. | |
| 2012/0003612 | A1 * | 1/2012 | Gerber et al. | 434/11 |
| 2012/0073178 | A1 | 3/2012 | Ivtsenkov et al. | |

OTHER PUBLICATIONS

Betzold, U.S. Statutory Invention Registration H538H1, Weapon firing inhibitor method and apparatus, issued Nov. 1, 1998.

Fernando Maymi and Paul Manz, "Ancile: Dismounted Soldier Tracking and Strike Warning," Article available online at http://www.dtic.mil/cgi-bin/GetTRDoc?AD=ada481283 (last visited Aug. 9, 2012), Report date of Nov. 1, 2006, Publication date unknown, likely on or after Nov. 1, 2006.

* cited by examiner

*Primary Examiner* — Timothy A Musselman
(74) *Attorney, Agent, or Firm* — Adam R. Stephenson, Ltd.

(57) ABSTRACT

A weapon direction training system and methods. A transmitter is configured to removably couple to a weapon of a trainee and continuously transmit a signal. A receiver is configured to be coupled to an observer and is configured to receive the signal when the weapon is pointed towards the observer. An alarm is configured to be coupled to the observer and is configured to activate one of an audio warning, a visual warning and a tactile warning when the weapon is pointed towards the observer, the audio warning, visual warning and tactile warning indicating that a muzzle infraction has occurred. Implementations of a method of muzzle infraction detection include notifying the observer of the muzzle infraction. In implementations the method includes notifying a third person of the muzzle infraction and providing a consequence to one of the trainee and the observer in response to the muzzle infraction.

13 Claims, 1 Drawing Sheet

WEAPON DIRECTION TRAINING SYSTEM AND RELATED METHODS

BACKGROUND

1. Technical Field

Aspects of this document relate generally to devices and methods used for weapon safety.

2. Background Art

Various devices and methods exist to promote or assist weapon safety. Weapon safety devices and methods attempt to prevent or reduce unintended injury due to firearms. Many individuals participate in training courses taught by instructors who train on various principles of weapon operation, use, and safety.

SUMMARY

Implementations of weapon direction training systems may include: a transmitter configured to removably couple to a weapon of a trainee, the transmitter configured to continuously transmit a signal from the transmitter; a receiver configured to be coupled to an observer, the receiver configured to receive the signal when the weapon is pointed towards the observer; and an alarm configured to be coupled to the observer and configured to activate one of an audio warning, a visual warning and a tactile warning in response to a receiver signal from the receiver indicating that the receiver has received the signal from the transmitter, the one of an audio warning, visual warning and tactile warning indicating that a muzzle infraction has occurred.

Implementations of weapon direction training systems may include one, all, or any of the following:

The signal may include an infrared laser signal.

The alarm and the receiver may both be included in an article of clothing configured to be worn by the observer.

The weapon may include a lethal firearm.

The weapon may include a non-lethal training firearm.

The transmitter may be configured to removably couple to a Picatinny rail of the weapon.

The receiver may be coupled to a vest configured to be worn by the observer.

Implementations of methods of muzzle infraction detection may include: coupling a transmitter to a weapon, the weapon configured to be carried by a trainee; continuously transmitting a signal from the transmitter; coupling a receiver to an observer; receiving the signal at the receiver in response to the weapon being pointed towards the observer, wherein the weapon being pointed towards the observer constitutes a muzzle infraction; and notifying a third person of the muzzle infraction in response to receiving the signal at the receiver.

Implementations of methods of muzzle infraction detection may include one, all, or any of the following:

Providing a feedback from the third person to the trainee in response to the third person being notified of the muzzle infraction.

Notifying the observer that the weapon was pointed at the observer.

Activating one of a visual warning, an audio warning and a tactile warning of an alarm configured to be coupled to the observer.

Coupling an alarm to the observer, the alarm included in an article of clothing configured to be worn by the observer.

Coupling the receiver to a vest configured to be worn by the observer.

Continuously transmitting the signal may include continuously transmitting an infrared laser signal.

Implementations of methods of weapon direction training may include: coupling a transmitter to a weapon, the weapon configured to be carried by a trainee; continuously transmitting a signal from the transmitter; coupling a receiver to an observer; receiving the signal at the receiver in response to the weapon being pointed towards the observer, wherein the weapon being pointed towards the observer constitutes a muzzle infraction; notifying the observer of the muzzle infraction; notifying a third person that the weapon was pointed at the observer, and; providing a consequence to one of the trainee and the observer in response to the muzzle infraction.

Implementations of methods of weapon direction training may include one, all, or any of the following:

Notifying the trainee that the weapon was pointed at the observer.

Activating one of a visual warning, an audio warning and a tactile warning of an alarm configured to be coupled to the observer.

Removing the trainee from a training exercise in response to a muzzle infraction.

Engaging in a simulation wherein the trainee is treated as a hostile threat.

Coupling the receiver to the Observer may include coupling an article of clothing to the observer, wherein the receiver is included in the article of clothing.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements.

DESCRIPTION

This disclosure, its aspects and implementations, are not limited to the specific components, assembly procedures or method elements disclosed herein. Many additional components, assembly procedures and/or method elements known in the art consistent with the intended weapon direction training system, methods of muzzle infraction detection and methods of weapon direction training will become apparent for use with particular implementations from this disclosure. Accordingly, for example, although pa color implementations are disclosed, such implementations and implementing components may comprise any shape, size, style, type, model, version, measurement, concentration, material, quantity, method element, step, and/or the like as is known in the art for such weapon direction training systems, methods of muzzle infraction detection and methods of weapon direction training, and implementing components and methods, consistent with the intended operation and methods.

Figure 1:
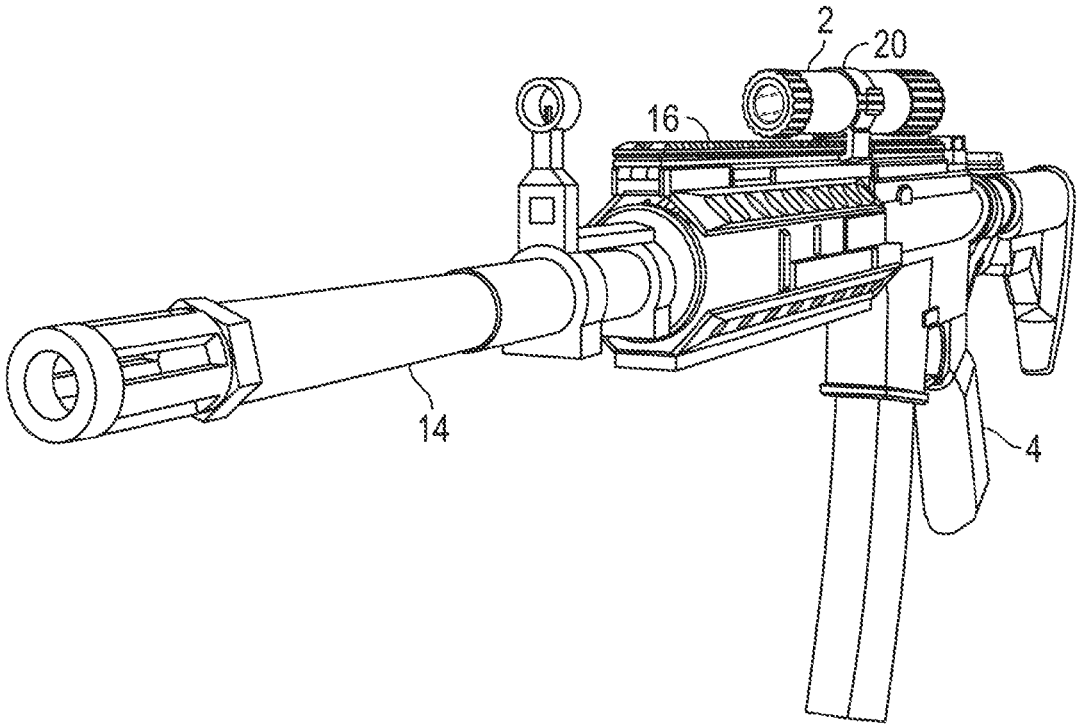
FIG. 1 is a perspective view of a transmitter of a weapon direction training system coupled to a weapon.
Figure 2:
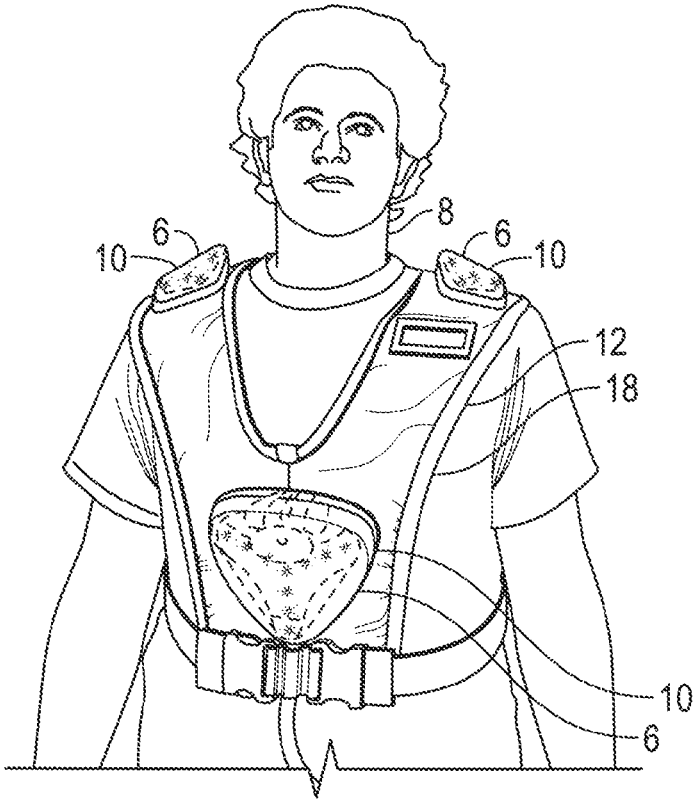
FIG. 2 is a front view of an article of clothing worn by an observer, the article of clothing having a receiver and alarm of a weapon direction training system coupled thereto.

Referring now to FIGS. 1 and 2, in various implementations a weapon direction training system includes a transmitter 2 configured to be coupled to a weapon 4, a receiver 6 configured to be coupled to an observer 8, and an alarm 10 also configured to be coupled to an observer 8. As used herein, when the muzzle or other exit point for ammunition from the weapon 4 is pointed in the direction of the observer 8, this condition is called interchangeably a "muzzle infraction" or a "muzzle violation."

Referring now to FIG. 1, the transmitter 2 of the weapon direction training system is configured to be coupled to a weapon 4. In implementations the weapon 4 is a lethal firearm, though in other implementations the weapon 4 may be a non-lethal firearm, such as a training firearm (such as, by non-limiting example, airsoft gun, a laser tag gun, and so forth). In implementations the weapon 4 may be a rifle, such as the assault rifle 14 depicted in FIG. 1, though in other implementations the weapon 4 could be any other type of firearm such as, by non-limiting example: a handgun; a revolver; a pistol; a submachine gun; a carbine; a battle rifle; a multiple barrel firearm; a sniper rifle; a squad automatic weapon; a light machine gun; a shotgun; a general purpose machine gun; a medium machine gun; a grenade launcher; a crossbow; a pistol crossbow; and the like.

The weapon 4 is configured to be carried by a trainee and a transmitter 2 is coupled to the weapon 4. The transmitter 2 in implementations is designed to transmit a signal, which continuously transmitted, i.e., a signal which is in a continuous "on" position during use (such as in a continuous wave laser). Although the transmitter 2 may be configured to continuously transmit the signal, in implementations the transmitter 2 may incorporate a manual or automatic electrical switch (such as a lever or automatic timer) and have an "off" setting during periods of non-use. In implementations the transmitter 2 may be configured to transmit the signal intermittently over a period of time, such as in pulses (as in the case of a pulsed laser source), or in some other noncontinuous emission (or non-continuous wave) manner. In some implementations the transmitter 2 may be configured to transmit the signal only when a safety of the weapon 4 is in an "off" position. In other implementations, the transmitter 2 may be configured to transmit the signal only when a trigger of the weapon 4 is depressed.

The signal utilized is a light signal or, in other words, constitutes a generally focused beam of electromagnetic radiation of a predetermined wavelength or range of wavelengths. In other implementations the signal could constitute something other than a light signal, such as a focused audio signal (in the audible or inaudible range, such as, by non-limiting example, modulated ultrasound). In various implementations the signal is a laser light signal. In implementations wherein the signal is a laser signal, various types of implementing components could be used to produce the laser signal such as, by non-limiting example: a gas laser; a chemical laser; an excimer laser; a solid-state laser; a disk laser; a fiber laser; a photonic crystal laser; a semiconductor laser (such as, by non-limit example, a laser diode); a dye laser; a free electron laser; a bio laser; and any other system or structure capable of producing coherent light signals. In various implementations the signal is an eye safe infrared laser signal, but in other implementations the signal could be any other laser light signal having a variety of wavelengths ranging from the ultraviolet to far infrared or any other wavelength or range of wavelengths used presently or in the future. In particular implementations, the use of an eye safe infrared signal may eliminate the possibility of eye damage occurring to the trainee and/or the observer.

In various implementations, the signal used in all transmitter 2 implementations may emit substantially the same laser signal. In others, the laser tight signal emitted by each transmitter 2 may be differ from the laser signal emitted by other transmitters 2. The different may be through variations in intensity, wavelength, pulse frequency, color, or any other distinguishing characteristic of the laser light signal. Where the transmitter 2 implementations emit different laser signals, implementations of the systems and methods herein may include the ability for a third party to learn exactly which transmitter 2 and, accordingly, which trainee, committed the muzzle infraction. Such implementations may be useful when a large number of trainees and observers are around each other and it may be difficult or impossible to determine which trainee committed a specific muzzle infraction against a specific observer. In these implementations, method implementations may include the ability for a receiver 6 to automatically communicate the identity of the transmitter 2 to the third person or the receiver 6 to tog the identity of or store the identity of the transmitter 2 for subsequent retrieval by the third person from memory associated with the receiver 6.

Referring still to FIG. 1, in implementations a transmitter mount 20 is utilized to couple the transmitter 2 to the weapon 4. In FIG. 1 the transmitter mount 20 is configured to couple to a Picatinny rail 16 of the weapon 4, though in other implementations the transmitter mount 20 could be configured to couple to a barrel, a handle, a scope, or some other component of, or location on, the weapon 4 that permits the transmitter 2 to be substantially parallel with the muzzle of the weapon 4. By non-limiting example, the transmitter 2 could be coupled to the side or underside of a barrel, muzzle, or other projectile delivery mechanism or element of the weapon 4. The transmitter 2 in implementations is removably coupled to the weapon 4 through the transmitter mount 20, though in implementations the transmitter 2 may be permanently coupled to the weapon 4 through the transmitter mount 20. In implementations the transmitter 2 may be releasably coupled to and/or decoupled from the transmitter mount 20 such as, by non-limiting example, by virtue of one or more of a snap closure, a screw, a bolt, a hook and loop fastener, a magnetic closure or fastener, or some other quick-release mechanism incorporated into the transmitter mount 20 such that the transmitter 2 may be easily coupled to the weapon 4, removed from the weapon 4 and/or switched out.

Referring now to FIG. 2, a receiver 6 is configured to be coupled to an observer 8. The receiver 6 in various implementations may included in, or coupled to, an article of clothing 12 such as a vest 18, which is configured to be worn by the observer 8. In other implementations, the receiver 6 may be incorporated into headgear worn by the observer 8 or take the form of a pack or other device worn on the back, front, or around the neck of the observer 8. In some implementations, an observer 8 may have multiple receivers 6 coupled to his/her self, such as is depicted in FIG. 2 wherein two receivers are coupled to the shoulder of the observer 8 (one to each shoulder) and one receiver 6 is coupled at or near the belly area of the observer 8. Receivers 6 may also be coupled at or near the head, back, arms, legs, feet, hands, face, and so forth, of the observer 8—in short, receivers 6 may be coupled at any location on the observer 8 and any number of receivers 6 may be used, as desired.

An alarm 10 is also configured to be coupled to the observer 8 and is configured to give a warning when the weapon 4 is pointed in the direction of the observer 8. In implementations this warning may be given simultaneously as the weapon 4 is pointed in the direct on of the observer 8, and in other implementations there may be some time delay between the pointing of the weapon 4 in the direction of the observer 8 and the warning, and/or the receiver 6 may be configured to log the instances wherein the weapon 4 was pointed at or near the observer 8 for later retrieval (such as, for instance, a silent mode wherein the alarm 10 is deactivated during a training exercise and data regarding instances of the weapon 4 being pointed at or near the observer 8, such as number and time of occurrences and/or length of time of each occurrence, and the identity of the transmitter and/or trainee is recorded for later retrieval and study). In implementation the alarm 10 is included in an article of clothing 12 configured to be worn by the observer 8, such as a vest 18. In implementations the alarm 10 may be included in an article of clothing 12 other than a vest 18, such as on or in a hat, a jacket, pants, a watch or wristband or glasses, shoes, a belt, earpiece, and the like. In various implementations, coupling the receiver 6 to the observer 8 includes coupling an article of clothing 12 to the observer 8, wherein the receiver 6 is included in, or coupled to, the article of clothing 12. In implementations the receiver(s) 6 and/or the alarm(s) 10 are standalone items in that they are not incorporated into an an article of clothing 12 but are otherwise configured to be coupled to the observer 8 or to an article of clothing 12 of the observer 8 such as by a tying mechanism, a pin mechanism (such as a safety pin), a hook-and-loop fastener mechanism, a friction mechanism, or any other mechanism, The weapon direction training system may utilize any number of alarms 10 and they may be coupled to the observer 8 at any location on the observer 8, similar to the receivers 6, as described above.

In the implementations shown in FIG. 2, the receivers 6 and alarms 10 are each included in a single unit, For example, at each shoulder of the observer 8 is a unit which includes both a receiver 6 and an alarm 10, and at or near the belly of the observer 8 is another unit which also includes both a receiver 6 and an alarm 10. In other implementations there may be only one receiver 6 and multiple alarms 10 (the alarms 10 all in communication with the receiver 6) or multiple receivers 6 and only one alarm 10. In implementations the alarm 10 may include, by non-limiting example, a. BLUETOOTH device in wireless communication with the receiver(s) 6, the BLUETOOTH device coupled to an ear of the observer 8 to give an audio warning to the observer 8, or coupled to the ear or elsewhere to give a tactile warning to the observer 8, such as by a vibrating mechanism, and no forth. In implementations a similar BLUETOOTH device could serve as an alarm 10 to give warning to the trainee when the weapon 4 is pointed at or near the observer 8.

The alarm 10 may be configured to give one or more or all of a visual warning, an audio warning and a tactile warning in response to the weapon 4 being pointed in the direction of the observer 8. By non-limiting example, in implementations when the weapon 4 is pointed at the observer 8, lights of the alarm 10 may be activated in an "on" or in a flashing "on and off" mode, while the alarm 10 may also or alternatively emit a noise, and the alarm 10 may also or alternatively vibrate or give some other tactile warning. These warnings may be configured to have different magnitudes in terms of tight intensity, sound level, and so forth, in order to either give warning only to the observer 8, or also to the observer 8 and to the trainee and/or to a third person, or others, engaged in or observing a simulation or training exercise. In implementations the alarm 10 may be configured to allow selection of which type of warning is given, be it audio, visual, or tactile, or some combination thereof. In implementations the alarm(s) 10 could be configured to increase the intensity of the warnings(s) as the direction of the weapon 4 gets closer to the observer 8, such as by increasing the volume of an audio warning, increasing the light intensity or altering the frequency of switching between "on" and "off" of a visual warning, increasing the intensity of vibration of a tactile warning, and so forth, and similarly decreasing the same as the weapon 4 is moved further away from being pointed at or near the observer 8. In such a manner the weapon direction training system could allow the trainee to become aware of when the weapon 4 is being pointed closer towards the observer 8 while at the same time assisting the trainee to avert actually pointing the weapon 4 at the trainee.

The distance between the trainee and the observer could be detected, by non-limiting example, by measuring the light intensity of the signal received by the receiver and calculating the corresponding distance between the receiver and the transmitter, other implementations, a highly directional signal could be employed, for example, a signal that has higher strength in the direction of the muzzle (or other firing component or firing direction) of a weapon 4, but less strength as one veers from this direction, could be utilized. Other mechanisms could be implemented, such as using two signals, a first, more focused signal and a second, less-focused signal, both being emitted from the transmitter 2 (or from two transmitters 2), such that the receiver 6 in general receives the second, less-focused signal first as the direction of the muzzle (or other firing component or firing direction) of the weapon 4 approaches the receiver 6, and if the direction of the muzzle (or other firing component) continues until it is more closely pointing at the receiver 6, the first, more focused signal will then be received. The alarm 10 in such an implementation could be configured to give a preliminary warning when receiving the less-focused signal, before the muzzle infraction actually occurs, to allow evasive maneuvers by the trainee and/or the observer 8 to avoid the muzzle infraction. In such an implementation, for instance, there could be a step-wise approach, where there is a pre-infraction warning from the alarm 10 when the second, less focused signal is received by the receiver 6, and then an actual muzzle infraction warning from the alarm 10 when the first, more focused signal is received by the receiver 6, with some difference in the type or intensity of the warnings being indicative of whether a pre-infraction incident is occurring (or has occurred) or whether an actual muzzle infraction is occurring (or has occurred).

In other implementations, the transmitter(s) 2 may emit more than two signals. For instance, by non-limiting example, one main signal could be focused along the length of the muzzle (or other firing implementation of the weapon 4) while multiple other signals could be focused slightly outward from the direction of the muzzle, with all of the signals being continuously transmitted by the transmitter(s) 2, such that the receiver 6 will be likely to receive one of these multiple other signals before receiving the main signal, thus allowing the implementation of the above described step-wise approach by giving one warning when one of the multiple other signals is received and a different warning when the main signal is received.

In implementations the weapon direction training system may be utilized in a method of muzzle infraction detection and/or in a method of weapon direction training. In various implementations a method of muzzle infraction detection and/or a method of weapon direction training may include coupling a transmitter 2 to a weapon 4, the weapon 4 being configured to be carried by a trainee, and continuously transmitting a signal from the transmitter 2; coupling a receiver 6 to an observer 8, and receiving the signal at the receiver 6 in response to the weapon 4 being pointed towards the observer 8, wherein the weapon 4 being pointed towards the observer 8 constitutes a muzzle infraction; and notifying a third person of the muzzle infraction (or, in other words, notifying the third person that the weapon 4 was pointed at or near the observer 8) in response to receiving the signal at the receiver 6. Implementations may also include coupling an alarm 10 to the observer 8, and the alarm 10 in implementations may be included in an article of clothing 12 configured to be worn by the observer 8. By non-limiting example, in implementations the method may include coupling the receiver 6 to a vest 18 configured to be worn by the observer 8. In implementations, continuously transmitting the signal may include continuously transmitting an infrared laser signal.

In implementations the sensitivity of the weapon direction training system could be varied as desired, such that a muzzle infraction constitutes not just pointing the weapon 4 directly at the observer 8, but also pointing the weapon 4 within a certain radius or area around or near the observer 8 or at specific portions of the body of the observer, as well, such as to dissuade the trainee from pointing the weapon 4 in a direction that is not necessarily directly towards the observer 8 but is close.

Notifying the third person of the muzzle infraction may be accomplished, by non-limiting example, by the third person noticing activation of the alarm 10 that is coupled to the observer 8. For example, in implementations the third person may see a visual warning or hear an audio warning given by the alarm 10 when a muzzle infraction has occurred. In other implementations the observer 8 may be a distance from the third person and/or in a location that is at least partially obscured from the view of the third person, so as to preclude the third person from observing these visual and/or audio warnings. In these implementations, other mechanisms could be utilized to notify the third person that a muzzle infraction has occurred. By non-limiting example, a second transmitter could be configured to be coupled to the observer 8 and configured to transmit a second signal indicating that a muzzle infraction has occurred, and this second signal could be received by a second receiver coupled to or carried by the third person, or the trainee who may be in close proximity to the third person. This second receiver may in turn cause a second alarm to notify the third person and/or the trainee, such as by an audio, visual, or tactile warning, that the muzzle infraction has occurred.

In some implementations of the method, the observer may not be notified of the infraction but only the third person. In other implementations, the only person being notified of the infraction may be the third person.

The method of muzzle infraction detection and/or method of weapon direction training may further include providing feedback from the third person to the trainee in response to the third person being notified of the muzzle infraction. By non-limiting example, in implementations the feedback may include one or more of the following, a penalty or as a training technique in response to a muzzle infraction: notifying the trainee that a muzzle infraction has occurred; deducting points from a point level of the trainee or a team of the trainee; adding or deducting points to/from a point level of the observer 8 or a team of the observer 8 (or other participant or team in a simulation or training exercise); locking the weapon 4 of the trainee so that it may not be fired (temporarily or throughout the remainder of a training exercise or simulation, or permanently); removing the weapon 4 from the trainee; engaging in a simulation wherein the trainee is treated as a hostile threat (such as, by non-limiting example, by a third person and/or members of a team of the trainee and/or others removing the trainee from an exercise or simulation and/or physically detaining trainee and/or physically removing the weapon 4 from the trainee, and so forth); or ejecting or removing the trainee from a simulation or training exercise.

In implementations a consequence may be provided to one or more of the trainee and the observer 8 in response to the muzzle infraction. By non-limiting example, in implementations the consequence may include one or more or all of the above examples of feedback. In other implementations, a consequence given to the trainee may constitute a losing score or a losing outcome in a training exercise or simulation, for the trainee and/or a team of the trainee, and or a visual or audio warning given to the trainee, and so forth. A consequence given to the observer 8 may be a simulation of the observer 8 being wounded or dying, such as by ejecting the observer 8 from a simulation or training exercise, or alternatively or additionally increasing or decreasing a point value of the observer 8 or of a team of the observer 8, or giving the observer 8 and/or a team of the observer 8 a winning outcome or a losing outcome in a training exercise or simulation, and so forth. By non-limiting example, in implementations the third person could remotely notify the trainee of a muzzle infraction via wireless communication and/or remotely lock the weapon 4 of the trainee through wireless controls in response to receiving notification of the muzzle infraction.

By non-limiting example, in implementations of a method of muzzle infraction detection and/or a method of weapon direction training the trainee may be engaged in a simulation whereby the trainee and the observer 8 are on a first team, and wherein other participants are on a second team, and wherein any of the aforementioned feedback or other consequences occur in response to the trainee engaging in a muzzle infraction. By non-limiting example, in a training exercise or simulation the first team may be engaged in a simulated skirmish against the second team, by airsoft or by laser signal or by other mechanisms, whereby obtaining a "hit" on a member of the opposite team results in a net increase in points, or some other positive occurrence, and whereby obtaining a muzzle infraction by having a weapon 4 point at a member of your own team results in a net decrease in points, or some other negative occurrence, such as losing a game or being ejected from the simulation, and so forth. In such a simulation, each member of each team may be both a trainee and an observer 8. Thus, in such a simulation each member of each team may have a weapon 4 with a transmitter 2 coupled thereto, and each member of each team may also have a receiver 2 coupled to his/her own self along with at least one alarm 10. In some simulations three or more teams could be incorporated into the training exercise. Such simulations may be incorporated, by non-limiting example, to train soldiers, law enforcement officers and/or citizens in general to be wary of friendly fire during armed conflict.

In other implementations the trainee may be on a first team, other participants may be on a second team (and/or other participants may be on a third team, a fourth team, and so forth, as desired), and the observer 8 (or multiple observers 8) may be on none of these teams but may be incorporated into the simulation as "passers-by" or "unarmed civilians," such that when a member of one team (trainee) gets a "hit" on a member of the opposite team, this results in a net increase in points or some other positive occurrence, but when a member of one team (trainee) has a muzzle infraction by having his or her weapon point at an innocent "passer-by" or "unarmed civilian" (i.e., one of the observers 8), this results in a net decrease in points or some other consequence for the trainee and/or for his or her team. In such a simulation, each member of each team may be a trainee but not an observer 8, and thus each member of each team would have a weapon 4 with a transmitter 2 coupled thereto, continuously transmitting the signal, and one or more (even many) observers 8 may be incorporated into the exercise, each observer 8 having a receiver 6 coupled to his/her self in communication with an alarm 10 also coupled to his/her self. Such a simulation may be incorporated, by non-limiting example, to train soldiers, law enforcement officers and/or citizens in general to be wary of, and ensure the safety of non-enemy civilians and other non-combatants during armed conflict, such as to simulate a police or military scenario where an enemy threat is present in a busy metropolitan area or other location where non-combatant civilians would also be present.

In implementations where pre-infraction warnings are implemented, or wherein variable warning levels are implemented to correspond with varying closeness of a weapon's muzzle (or other tiring implement) towards an observer 8, as previously described above, any pre-infraction warning or incident which does not actually result in a muzzle violation may result in a lesser consequence than a muzzle infraction, such as less points deducted than an actual muzzle infraction, or a simulation of the observer 8 being non-fatally wounded (such as disallowing use of one limb by temporarily immobilizing it), or some other simulation, as opposed to simulating the death or removal of that team member, and so forth.

Methods of muzzle infraction detection and/or methods of weapon direction training may also include notifying the observer 8 that the weapon 4 was pointed at or near the observer 8 and, therefore, notifying the observer 8 of a muzzle infraction. By non-limiting example, in implementations the alarm 10, which is configured to be coupled to the observer 8, may be activated in response to the weapon 4 being pointed at or near the observer 8, and thus activating one or more of a visual warning, a tactile warning and an audio warning of the alarm 10 coupled to the observer 8 to give one or more of an audio warning, a visual warning, and a tactile warning (such as by a vibration mechanism or some other tactile mechanism order to notify the observer 8 that the weapon 4 was pointed at or near the observer 8.

The method of muzzle infraction detection and/or the method of weapon direction training may also include notifying the trainee that the weapon 4 was pointed at the observer 8. This may be accomplished, by non-limiting example, by the trainee perceiving the activated alarm 10 that is coupled to the observer 8 (such as by seeing an activated light, or hearing an activated audio warning), or by the observer 8 giving some other signal or notification to the trainee, or by a third person giving some other signal or notification to the trainee, and so forth, In implementations a third receiver may be coupled to the trainee or to the weapon 4, and the third receiver may receive the second signal transmitted from the second transmitter, and the third receiver may be in communication with a third alarm to notify the trainee, by one or more of visual, audio, or tactile warning, that a muzzle infraction has occurred.

In implementations the weapon direction training system could operate in somewhat altered methods as compared with those described above. By non-limiting example, in implementations the transmitter 2 could be coupled to the observer 8 instead of to the weapon 4, and the receiver 6 could be coupled to the weapon 4 instead of to the observer 8, such that the weapon 4 only receives the signal when the weapon 4 is pointed at or near the observer 8, thus triggering one or more alarms 10 coupled to either or both of the trainee and the observer 8 (an alarm 10 coupled to the observer 8 could be triggered, by non-limiting example, by reflecting or re-sending the signal, or sending another signal, from the receiver 6 or some other component coupled to the weapon 4 or the trainee, to an alarm 10 coupled to the observer 8).

In places where the description above refers to particular implementations of weapon direction training systems, methods of muzzle infraction detection, methods of weapon direction training, and implementing components, sub-components, methods and sub-methods, it should be readily apparent that a number of modifications may be made without departing from the spirit thereof and that these implementations, implementing components, sub-components, methods and sub-methods may be applied to other weapon direction training systems, methods of muzzle infraction detection and methods of weapon direction training.

What is claimed is:

1. A method of muzzle infraction detection, comprising:
coupling a transmitter to a weapon, the weapon configured to be carried by a trainee;
continuously transmitting a signal from the transmitter;
coupling a receiver to an observer;
receiving the signal at the receiver from the transmitter in response to the weapon being pointed towards the observer, wherein the weapon being pointed towards the observer is a muzzle infraction; and
notifying a third person of the muzzle infraction in response to receiving the signal at the receiver.

2. The method of claim 1, further comprising providing a feedback from the third person to the trainee in response to the third person being notified of the muzzle infraction.

3. The method of claim 1, further comprising notifying the observer that the weapon was pointed at the observer.

4. The method of claim 1, further comprising activating one of a visual warning, an audio warning and a tactile warning of an alarm, the alarm coupled to the observer.

5. The method of claim 1, further comprising coupling an alarm to the observer, the alarm comprised in an article of clothing worn by the observer.

6. The method of claim 1, further comprising coupling the receiver to a vest worn by the observer.

7. The method of claim 1, wherein continuously transmitting the signal comprises continuously transmitting an infrared laser signal.

8. A method of weapon direction training, comprising:
coupling a transmitter to a weapon, the weapon configured to be carried by a trainee;
continuously transmitting a signal from the transmitter;
coupling a receiver to an observer;
receiving the signal at the receiver from the transmitter in response to the weapon being pointed towards the observer, wherein the weapon being pointed towards the observer is a muzzle infraction;
notifying the observer of the muzzle infraction;
notifying a third person that the weapon was pointed at the observer, and;
providing a consequence to one of the trainee and the observer in response to the muzzle infraction.

9. The method of claim 8, further comprising notifying the trainee that the weapon was pointed at the observer.

10. The method of claim 8, further comprising activating one of a visual warning, an audio warning and a tactile warning of an alarm coupled to the observer.

11. The method of claim 8, wherein providing a consequence to the trainee further comprises removing the trainee from a training exercise in response to a muzzle infraction.

12. The method of claim 8, further comprising engaging in a simulation wherein the trainee is treated as a hostile threat.

13. The method of claim 8, wherein coupling the receiver to the observer comprises coupling an article of clothing to the observer, wherein the receiver is comprised in the article of clothing.

* * * * *